US005413245A

United States Patent [19]

Wright

[11] Patent Number: 5,413,245

[45] Date of Patent: May 9, 1995

[54] VENDING SYSTEM HAVING IMPROVED VENDING ACCESS AND IDENTIFICATION

[75] Inventor: Christopher B. Wright, San Francisco, Calif.

[73] Assignee: Wright Food Systems, Inc., San Francisco, Calif.

[21] Appl. No.: 918,573

[22] Filed: Jul. 22, 1992

Related U.S. Application Data

[63] Continuation-in-part of Ser. No. 823,563, Jan. 22, 1992, Pat. No. Des. 350,987.

[51] Int. Cl.[6] ..... A24F 15/04

[52] U.S. Cl. ..... 221/24; 221/131; D. 20/5

[58] Field of Search ..... 221/24, 197, 199, 131, 221/132, 120, 119; 312/204, 287, 283, 284; 222/78; D20/5, 4; 194/350

[56] References Cited

U.S. PATENT DOCUMENTS

| | | | |
|---|---|---|---|
| D. 227,300 | 6/1973 | Yamada | D20/4 |
| 641,917 | 1/1900 | Young et al. | 222/78 |
| 1,897,072 | 2/1933 | Parks et al. | 222/78 |
| 2,382,350 | 8/1945 | Testi | 221/24 |
| 2,978,085 | 4/1961 | Stoyton et al. | D20/5 |
| 4,225,201 | 9/1980 | Davis | 312/284 |
| 4,320,933 | 3/1982 | Felix et al. | 312/204 |
| 5,067,630 | 11/1991 | Nesser et al. | 221/197 |
| 5,090,589 | 2/1992 | Brandes et al. | D20/5 |

FOREIGN PATENT DOCUMENTS

| | | | |
|---|---|---|---|
| 11830 | 2/1928 | Australia | 222/78 |
| 3814231 | 11/1988 | Germany | 221/131 |
| 3241487 | 10/1991 | Japan | 221/131 |
| 122785 | 8/1990 | Spain . | |
| 2025473 | 8/1990 | Spain . | |
| 2029427 | 3/1991 | Spain . | |

*Primary Examiner*—Kenneth W. Noland
*Attorney, Agent, or Firm*—Ostrager, Chong & Flaherty

[57] ABSTRACT

A vending system employs a vending machine with a cylindrical body and removably mounted top and bottom endpieces that allow the external appearance of the machine to be changed according to the type of product to be vended. The ornamentation can be formed in shapes resembling standard types of beverage cans, bottles, and other types of containers. A preferred version of the machine has two arcuate doors on opposing sides of the machine to allow vending access and refilling on both sides of the machine. Door-mounted components, including payment mechanism, selection buttons, and dispenser slot, are arranged vertically in a line at the deepest part of the door, and an offset two-array stacking configuration of the beverage units is used to obtain an optimal storage capacity of the machine. Other versions include a full cylindrical version or a semi-cylindrical one with one door for installations allowing vending access from the front only.

16 Claims, 9 Drawing Sheets

FIG.3
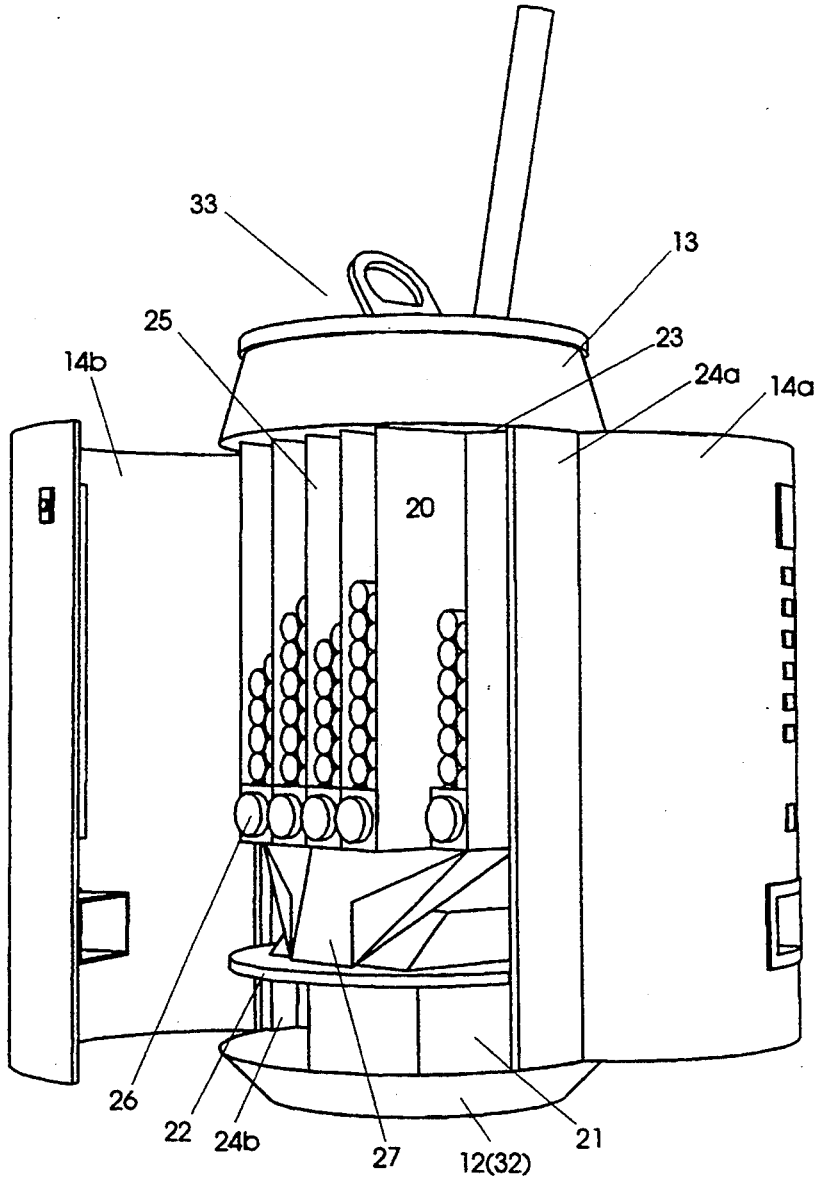
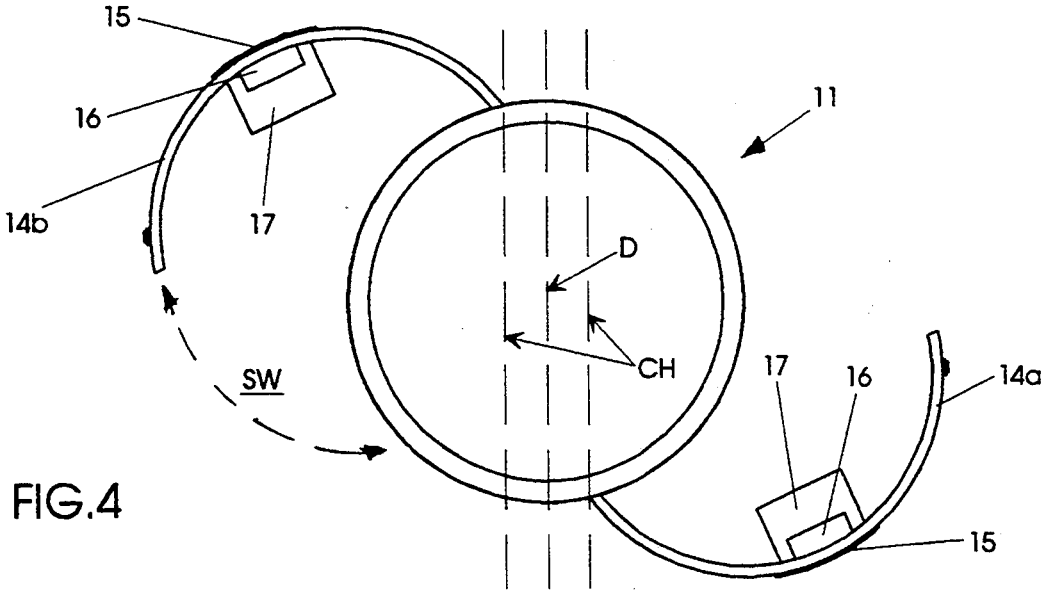
FIG.4

VENDING SYSTEM HAVING IMPROVED VENDING ACCESS AND IDENTIFICATION

This patent application is a continuation-in-part of U.S. Des. patent application Ser. No. 07/823,563 by the same inventor, filed on Jan. 22, 1992, entitled "Vending Machine" now U.S. Pat. No. D 350,987 a design.

FIELD OF THE INVENTION

The present invention generally relates to a vending system, and particularly to a vending machine having structures providing multiple vending access and removably mounted ornamentation for greater product identification.

BACKGROUND OF THE INVENTION

Conventional vending machines typically have an upright quadrangular form with a rectangular door at the front side of the machine. Such vending machines are manufactured, for example, by Dixie-Narco, Inc., of Williston, S.C., for standard sized beverage cans (12 oz.) or plastic bottles (10 or 16 oz.). The rectangular door is hinged to the front side of the vending machine and has a height and width generally the same as that of the machine itself, i.e., (56 in. by 28 in., or 72 in. by 37 in.). A coin slot or other payment device and selection buttons for different beverage brands are arranged at an upper or side portion of the door frame, and a dispenser slot is arranged toward a bottom portion of the door frame. The beverage cans are arranged in parallel vertical stacks within the machine interior, and respective dispenser control mechanisms are used to release beverage cans from the respective stacks. The stacks are refilled and the machine is serviced by workers from the front door.

The conventional vending machines are deemed to have the following disadvantages. The machines are required to be situated with their back sides facing a wall with their front sides providing access to users. Thus, they can only be located against a wall in any vending area. There are many large open areas that would be suitable for vending, for example, train stations, subway stations, sidewalks, waiting rooms, cafeterias, etc., but they cannot be used for vending machines except along the walls thereof. Moreover, since the machines provide access on only the front side, they cannot be used for selling beverages during the time that they are being refilled or serviced. The full-width door also takes up a large swing area when it is opened for refilling or servicing.

SUMMARY OF THE INVENTION

According to the present invention, a vending system for beverage cans or bottles is formed in a cylindrical shape and provides vending access via two arcuate doors on opposite sides of the machine. The vending machine is therefore not confined to location along a wall. Instead, it may be located in open areas, with vending access provided to two lines of people from opposite sides of the machine.

The vending machine employs a common interior frame housing a number of vertical stacks arranged in parallel for cans or bottles, respective dispenser mechanisms and dispenser chute for the stacks, and a refrigeration unit. The arcuate doors are hinged to the frame with external surfaces that are flush with the overall cylindrical shape of the machine. The frame includes mountings for ornamental endpieces can be attached at its top and bottom portions. For example, the endpieces may have a beveled truncated conical shape so that the machine externally resembles a standard form of beverage can. At the top of the machine, further ornamentation may be provided, for example, with shapes resembling a drinking straw and/or opener tab. Alternatively, ornamental endpieces resembling a standard form of plastic bottle may be mounted to the common interior frame. The can or bottle ornamentation reinforces the consumers propensity to purchase beverages, as well as identifies the presence of the vending machine within large crowded areas. Illuminated display surfaces may be provided on the doors for display of logos and beverage images. These features allow for instantaneous product identification by consumers.

If the machine is located free-standing in an open area, the power cord for the machine can run from a ceiling outlet down into a hidden tube in the top ornamentation of the machine, or from an outlet installed in the floor. The appearance of a free-standing beverage vending machine in an open area with ready access from all sides, unconstrained by power cord placement, would be attractive to and easily recognized by consumers.

Other versions of the beverage vending machine include a full cylindrical shape and a semi-cylindrical shape with only one arcuate door at the front of the machine. Although this version has vendable access on only one side and must be located along a wall, its external shape resembling a beverage can or bottle and/or top ornamentation would be attractive to consumers.

The door(s) of the beverage vending machine of the present invention are formed in an arcuate shape with external surfaces flush with the cylindrical surface of the machine. The doors are hinged using so-called "piano hinges" extending in a vertical line along the height of the main body portion of the machine between its top and bottom portions. The door width is a chord of the cylinder that is less than the full diameter of the cylinder. The reduced door width and arcuate external surface of the door allow it to take up about one-third less swing area as compared to the full-width rectangular door of a conventional vending machine when the machine is being refilled or serviced.

The payment mechanism, selection buttons, and dispenser slot are arranged vertically along a centerline of the door where the door's depth is at a maximum. The vertical in-line arrangement is visually pleasing and also guides the user's movements easily from payment, to selection, to retrieval. The vertical in-line arrangement of these mechanisms also occupies a minimal space internally, thereby allowing a more optimal arrangement of stacks and greater number of units to be stacked therein, as compared to a conventional rectangular vending machine of comparable total volume. Wiring harnesses from the main power unit in the central core of the machine are passed into the door(s) of the machine via a passage(s) provided near the hinge(s).

Within the interior frame of the cylindrically shaped vending machine, two sets of dispensing stacks are provided for dispensing and refilling beverage units from both sides of the machine. Dispenser controls are provided for the respective stacks to release a selected beverage unit down a chute to a dispenser slot on the door. The refrigeration unit may be arranged at the top or bottom portions of the machine.

Other objects, features, and advantages of the present invention will now be described in detail with reference to the drawings, of which:

BRIEF DESCRIPTION OF THE DRAWINGS

FIG. 3 is a perspective view of the cylindrical vending machine with its two arcuate doors opened, and further having external ornamentation resembling a standard for of beverage can with a straw and opener tab.

FIG. 4 is a schematic plan view showing the cylindrical vending machine with its two arcuate doors opened.

DETAILED DESCRIPTION OF THE INVENTION

Figure 1:
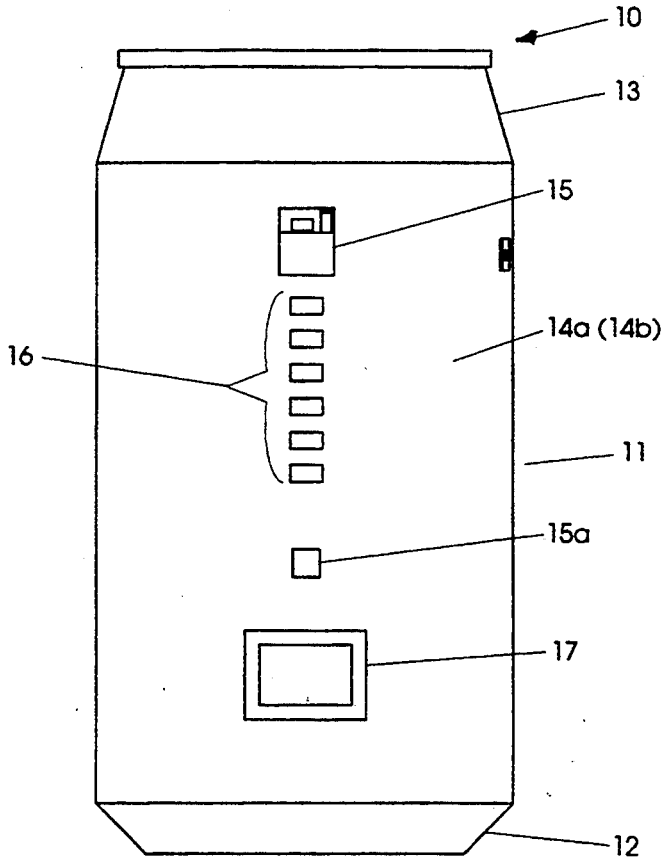
FIG. 1 is a front view of a cylindrically-shaped beverage vending machine in accordance with the present invention.
Figure 2:
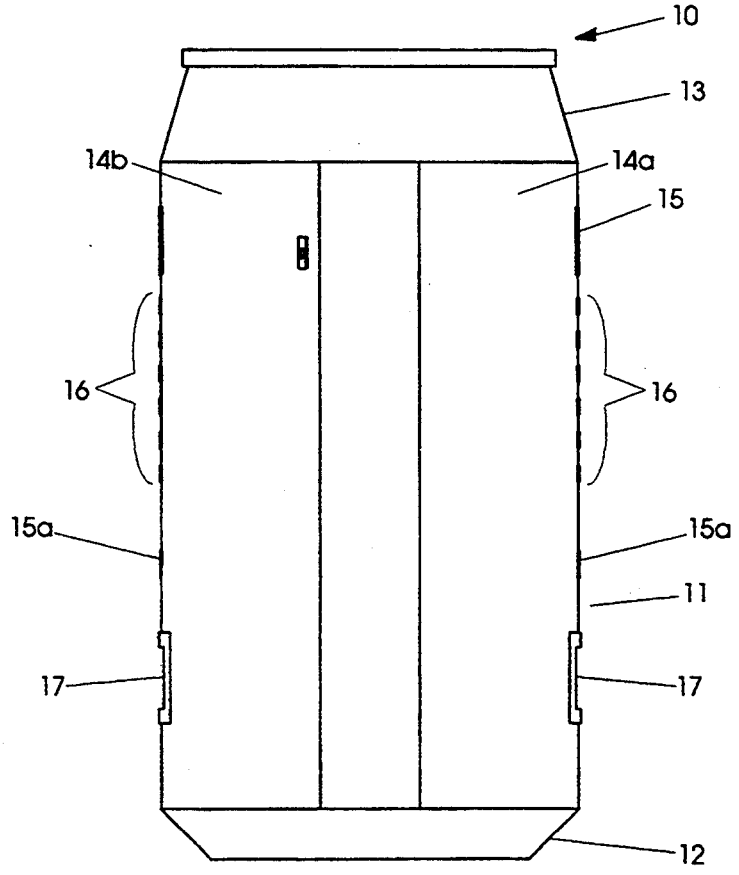
FIG. 2 is a side view of the cylindrical vending machine in a version having two arcuate doors providing multiple vending access from opposite sides of the machine.

Referring to FIGS. 1 and 2, the vending system of the present invention has a vending machine 10 in a cylindrical shape. The vending machine has a main body portion 11, a bottom portion 12, and a top portion 13. In the two-door version shown, doors 14*a*, 14*b* have arcuate surfaces that are flush with the cylindrical shape of the vending machine, and can provide vending access to two lines of consumers on opposing sides of the machine. Each door has a payment mechanism 15, which may be a coin mechanism or combined bill/coin mechanism, a bank of beverage selection buttons 16, a coin return slot 15*a*, and a dispenser slot 17 arranged in a vertical line. The vertical in-line arrangement is visually pleasing and also guides the user's movements easily from payment, to selection, to retrieval.

In FIGS. 3 and 4, the arcuate doors 14*a*, 14*b* are shown opened from the main body portion 11. A common interior frame 20 resides within the main body portion 11. The interior frame is formed structurally of a base 21, a lower mounting plate 22, an upper mounting plate 23, and opposite side panels 24*a*, 24*b*. In the version shown, the base 21 also housing the refrigeration unit for the vending machine, and top and bottom ornamental endpieces 32 and 33 are mounted to the interior frame resembling a standard form of beverage can with a straw and opener tab.

The doors 14*a*, 14*b* are hinged to the respective side panels 24*a*, 24*b* using so-called "piano hinges" extending in a vertical line along the height of the main body portion between the top and bottom portions 12 and 13. Wiring harnesses 28 running from a main power and electronics control unit (not shown) in the interior of the machine are passed into the doors of the machine via passages provided near the hinges. The doors and side panels may be formed from high-impact plastic or sheet steel. The walls enclosing the storage space are lined with thermal insulation. As shown in FIG. 4, the width of the door is a chord CH of the cylinder that is less than the full diameter D of the cylinder. The reduced door width and arcuate external surface of the door allow it to take up about one-third less swing area (indicated by the double-headed dashed arrow and the area SW) as compared to the full-width rectangular door of a conventional vending machine.

Within the interior frame 20, a number of vertical stacks 25 are arranged in parallel for stacking beverage cans or bottles therein and have respective dispenser control mechanisms 26 for releasing the selected beverage units into respective drop chutes 27 which conveys the selected unit into the dispenser slots 17 on the respective doors of the machine. As is well known in the industry, the beverage units may be stacked in a double row configuration, with a paddle-type rotary dispenser releasing units alternately from the double rows.

Figure 5:
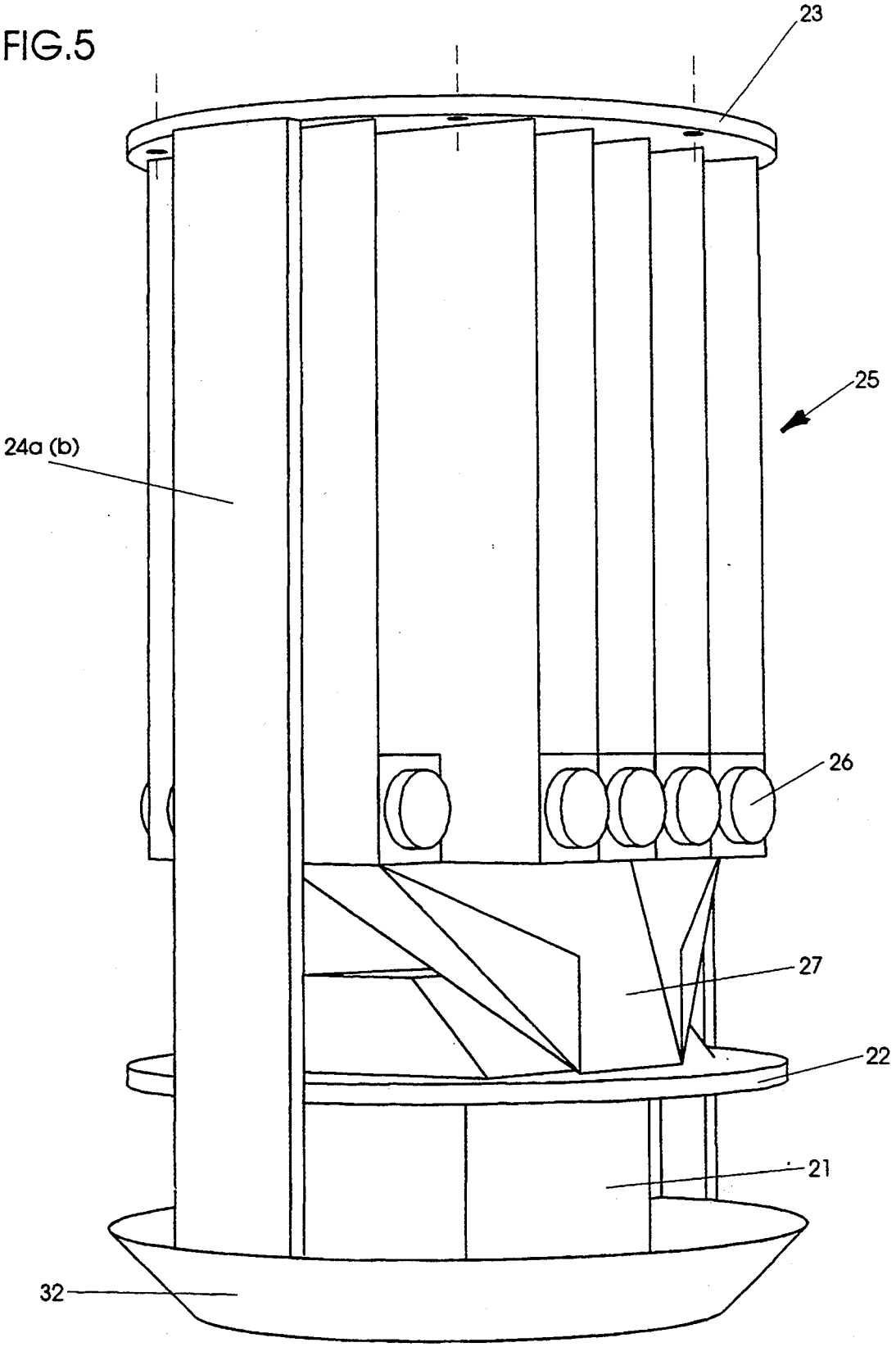
FIG. 5 is a perspective view showing the common interior frame of the cylindrical vending machine, and an upper mounting plate for top ornamentation.
Figure 6:
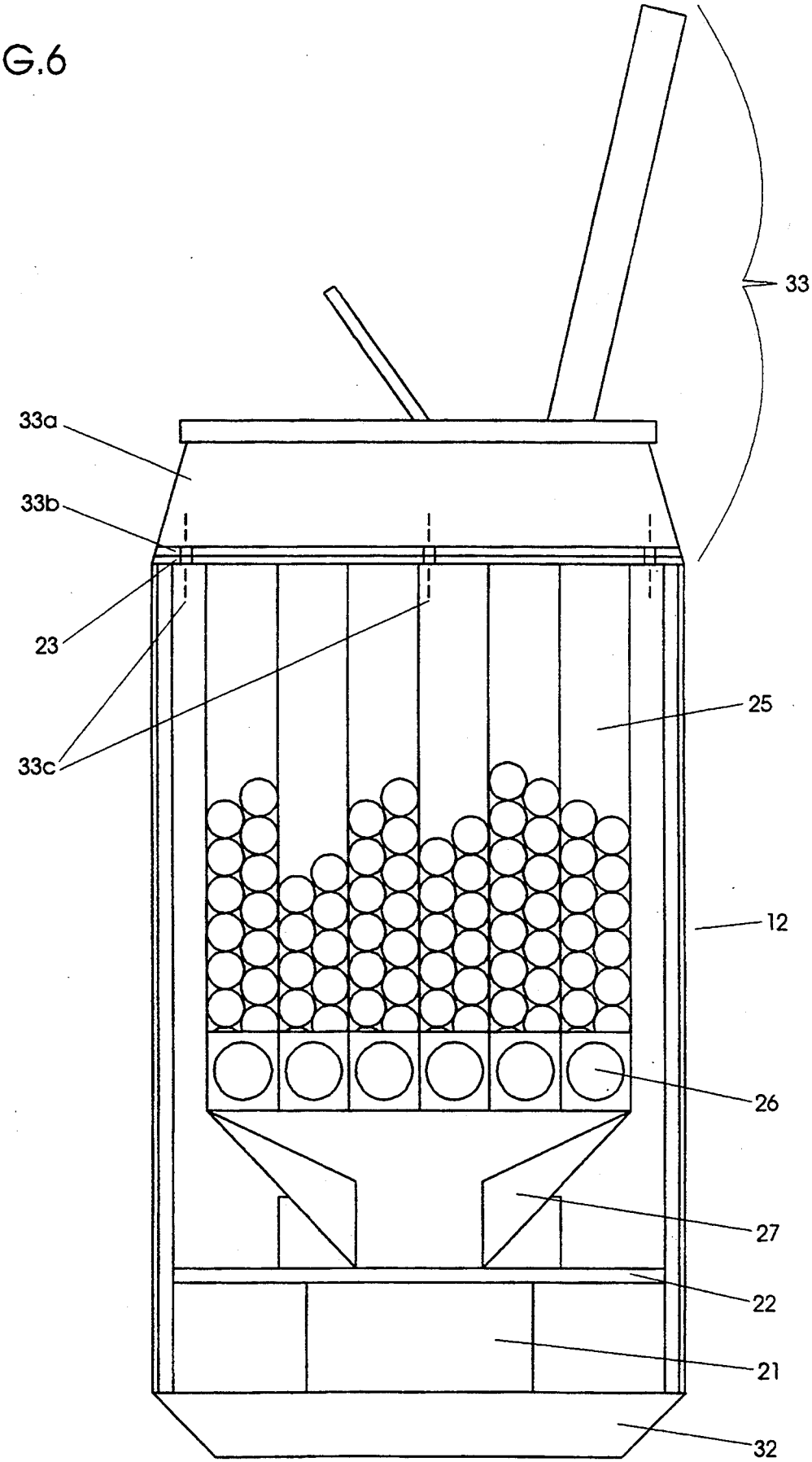
FIG. 6 is a schematic front view of the cylindrical vending machine illustrating the mounting of the top ornamentation.

In FIGS. 5 and 6, the mounting of the ornamental endpieces to the interior frame is shown in greater detail. The bottom endpiece 32 can be a base plate with a beveled skirt into which the interior frame with its base 21 and side panels 24*a*, 24*b* are seated and fixedly mounted. Alternatively, the bottom endpiece 32 can be only a beveled skirt which is secured to the lower ends of the side panels 24*a*, 24*b*. The top endpiece 33 (resembling a can top in these figures) is in the form of a cowling 33*a* with a recessed plate 33*b* that is seated on top of the upper mounting plate 23 of the interior frame 20 and secured thereto with bolts through bolt holes 33*c*. The top endpiece is thus removably mounted to the frame to allow it to be readily changed according to the type of product to be vended.

Figure 7:
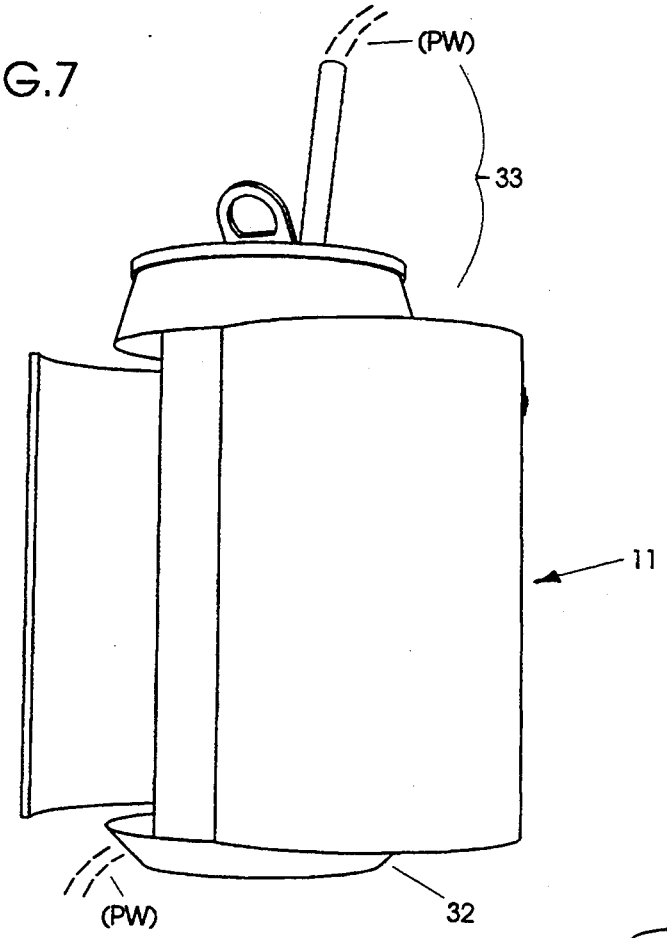
FIGS. 7 and 8 are perspective views showing, comparatively, the two-door version of the cylindrical vending machine with ornamentation resembling a beverage can and a beverage bottle.
Figure 8:
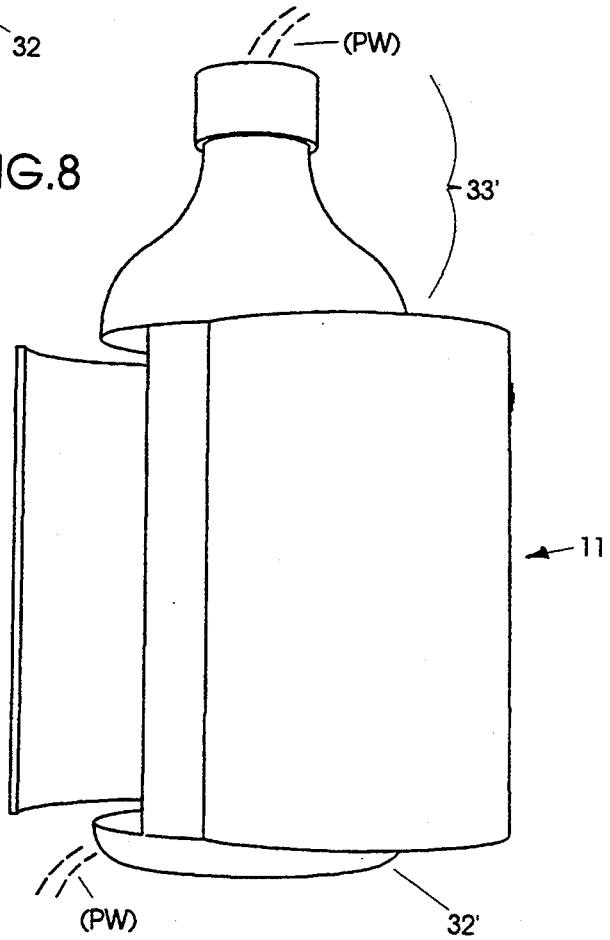

The use of a common interior frame 20 and cylindrical main body portion 11, with detachable mountings for the top and bottom ornamentation, allows the same structure to be used with ornamentation resembling different types of beverage containers. As shown comparatively in FIGS. 7 and 8, the top and bottom endpieces 32, 33 may be formed with beveled truncated conical shapes resembling a standard form of beverage can, or endpieces 32', 33' may be formed resembling a standard type of plastic bottle. At the top portion, other ornamentation may be provided, for example, resembling a drinking straw and/or opener tab.

The use of removably mounted ornamentation allows the external appearance of the vending machine to be changed according to the specific type of products to be vended, e.g., cans, plastic bottles, long-neck bottles, screw-top containers, etc. This product-specific ornamentation reinforces the consumers' propensity to purchase the product. The attractive appearance and height of the top ornamentation also identifies the presence of the vending machine within large crowded areas. Illuminated display surfaces may be also provided on the doors for display of logos and product images that are aesthetically pleasing and attractive to consumers. If the machine is located free-standing in an open area, the power cord PW for the machine can run from a ceiling outlet down into the top ornamentation of the machine, or from an outlet installed in the floor.

Figure 9:
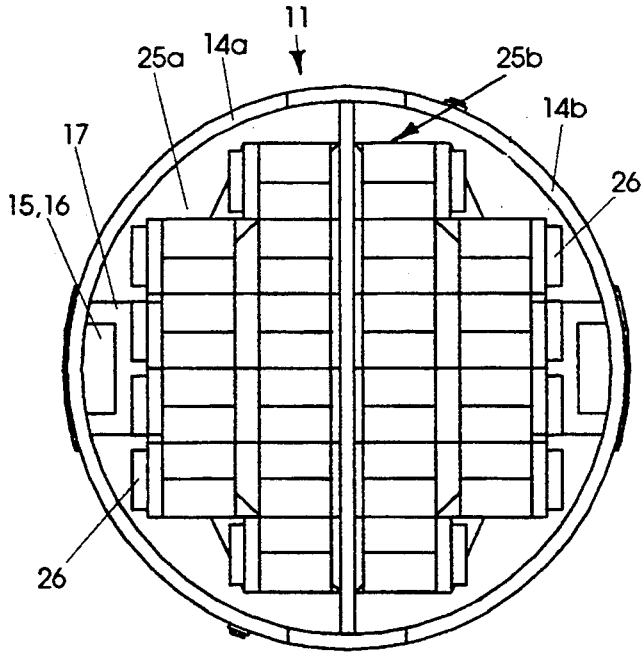
FIGS. 9 and 10 are schematic plan views illustrating the arrangement of the stacks and the door-mounted payment, selection, and dispenser mechanisms in the cylindrical vending machine.
Figure 10:
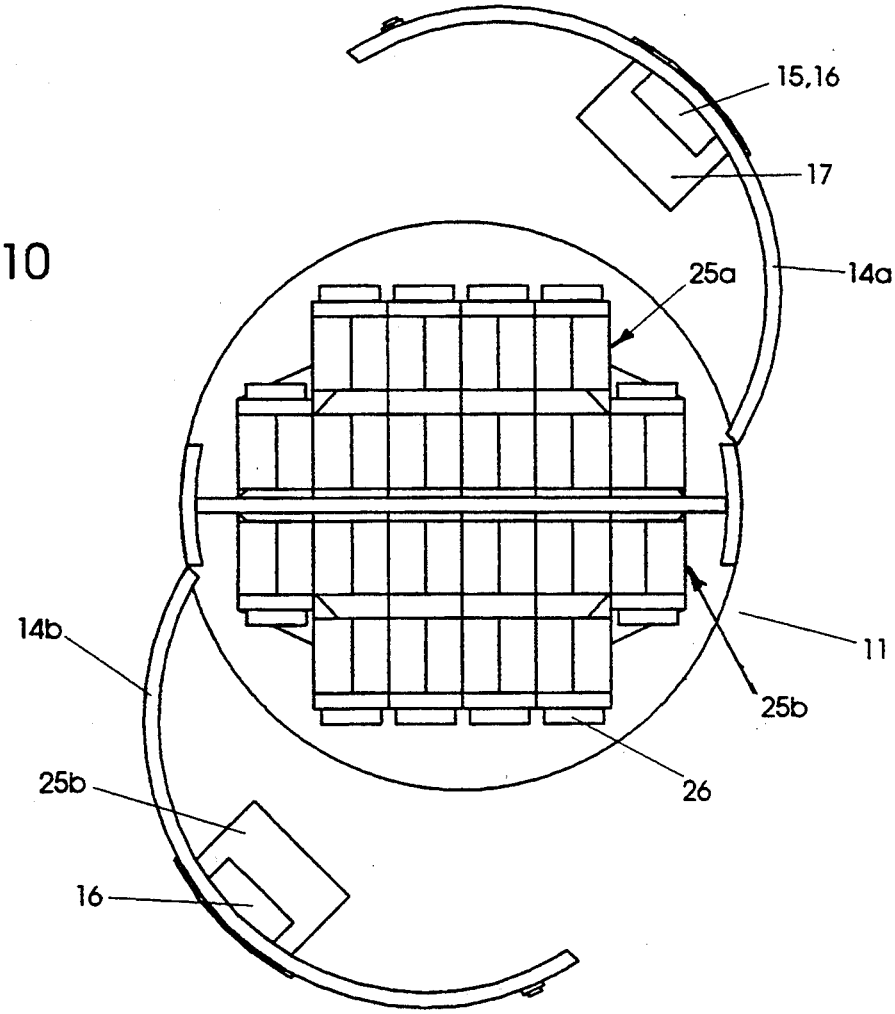

In FIGS. 9 and 10, the space-efficient and optimally compact fit of the doors and door-mounted components with the interior frame and stacks is shown. The payment mechanism 15, bank of selection buttons 16, and dispenser slot 17 are arranged vertically along a centerline of the door where the door's depth is at a maximum. The stacks of beverage units are arranged in two sets 25*a*, 25*b* for each side of the machine. Each set has two arrays (front and back) of vertical stacks. The arrays have a number of stacks each that allows offset spacing within the confines of the cylindrical main body 11, for example, 4 and 6 stacks, respectively, of beverage units in double row configuration. The door-mounted components fit in the empty space in the deepest part of the curvature of the door proximate the front array. The arrangement of the stacks and door-mounted components achieves an optimal density allowing a greater number of beverage units to be stacked in the machine, as compared to conventional rectangular vending machines of comparable total volume.

Figure 11A:
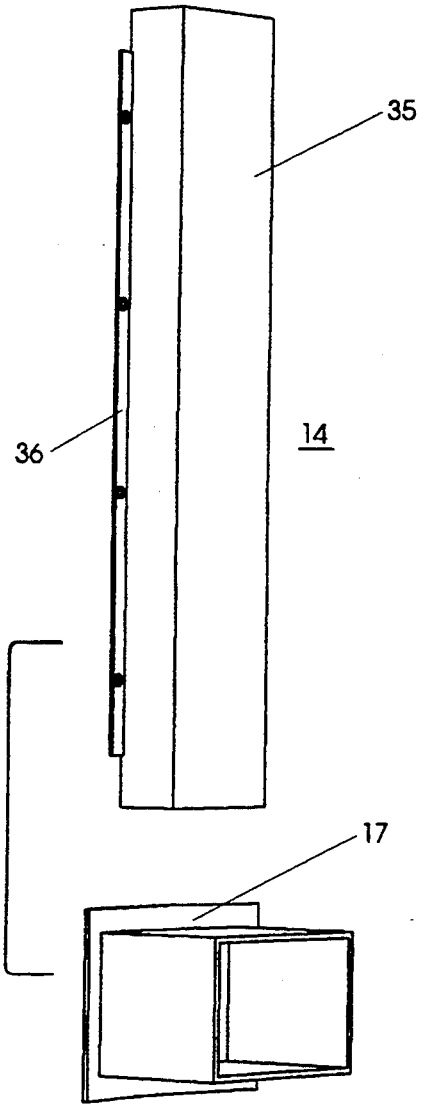
FIGS. 11A and 11B are schematic views showing the back and front of the door-mounted payment, selection, and dispenser mechanisms.
Figure 11B:
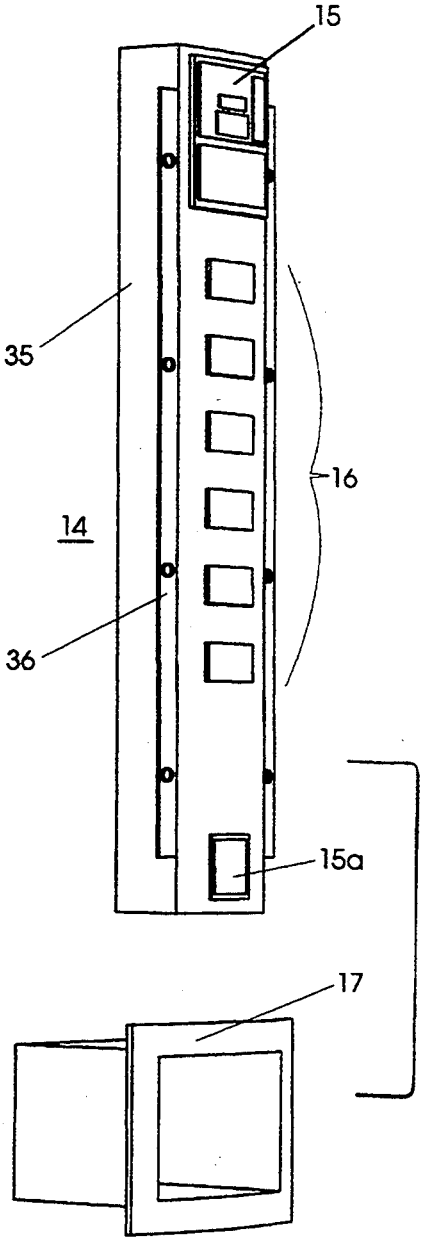

In FIGS. 11A and 11B, the payment mechanism 15, bank of selection buttons 16, and coin return slot are shown incorporated integrally in one vertical compartment 35 that is mounted by mounting flanges 36 through the wall of the door 14. The dispenser slot 17 is similarly mounted through the door just below the components compartment 35.

Figure 12:
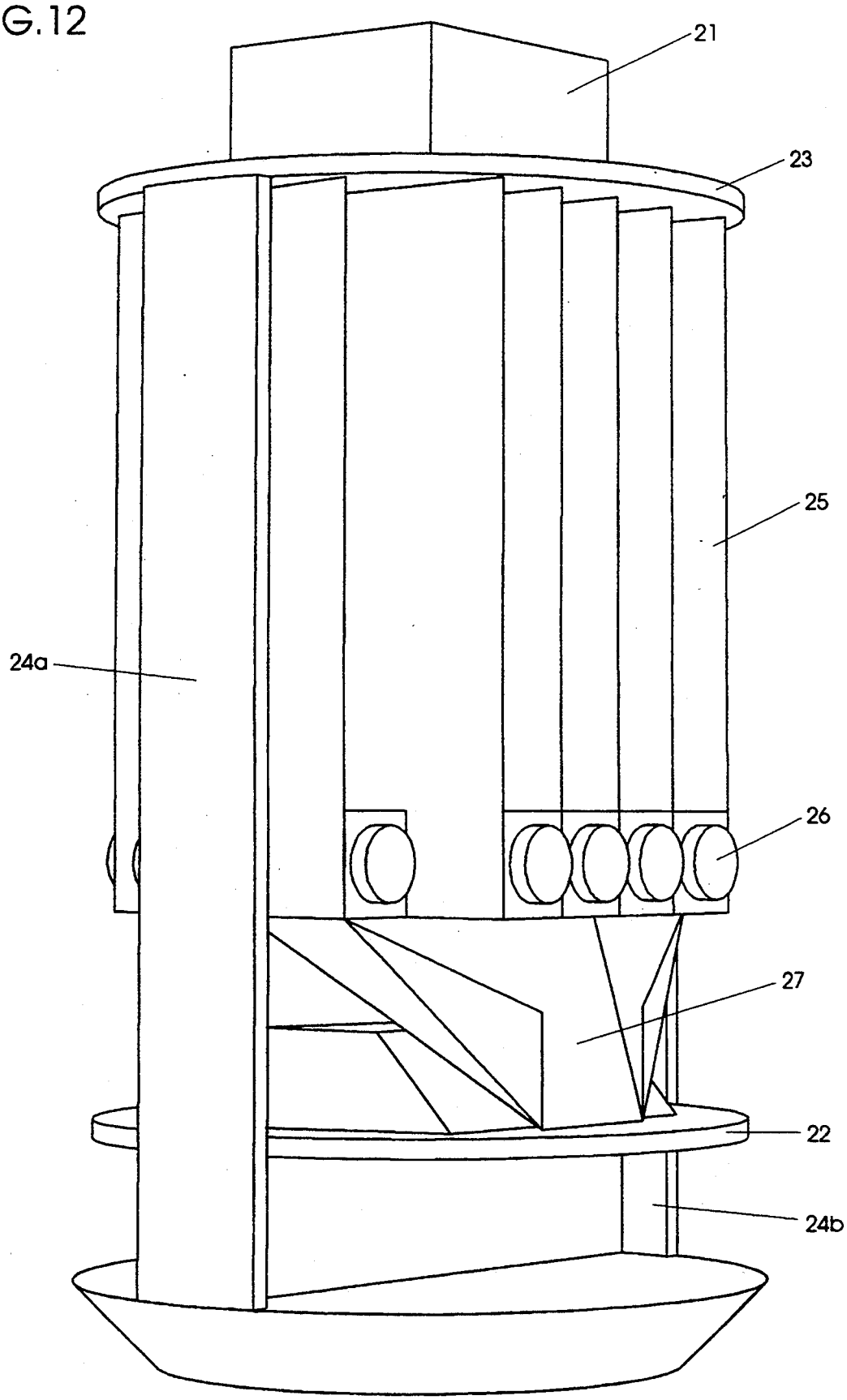
FIG. 12 is a perspective view showing the common interior frame of the cylindrical vending machine, and the refrigeration unit mounted on the upper mounting plate for the top ornamentation.

In FIG. 12, another version of the vending machine has the refrigeration unit 21 located on top of the upper mounting plate 23 where it is hidden under the cowling of the upper ornamental endpiece 33. As is known in the industry, the refrigeration unit includes a compressor for pumping the refrigerant fluid through condenser and evaporator coils to provide a cooling output into the beverage storage in the main body portion of the vending machine. The waste heat is exhausted through vents in the bottom or top portions of the machine.

Figure 13:
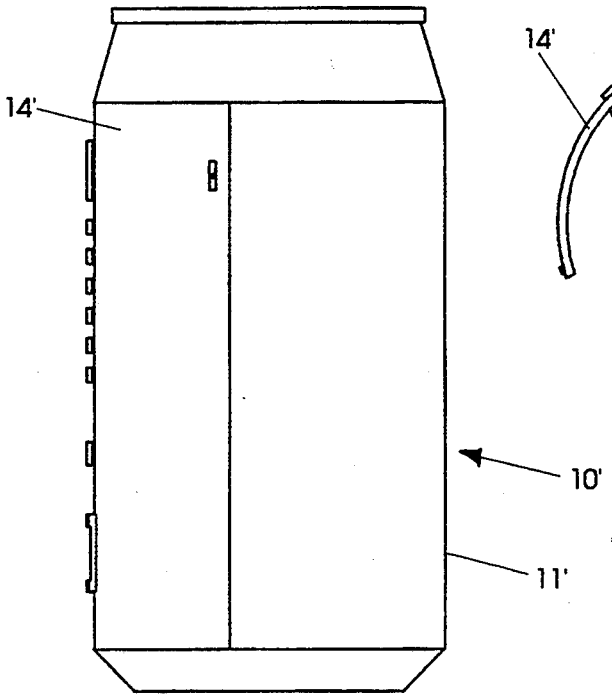
FIGS. 13 and 14 are side and plan views of a version of a full cylindrical vending machine with one front door.
Figure 14:
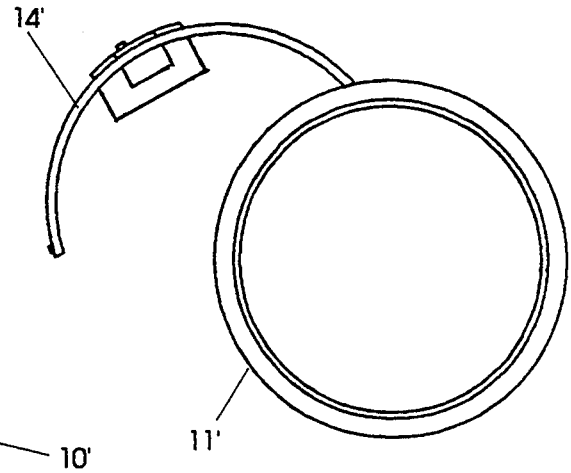
Figure 15:
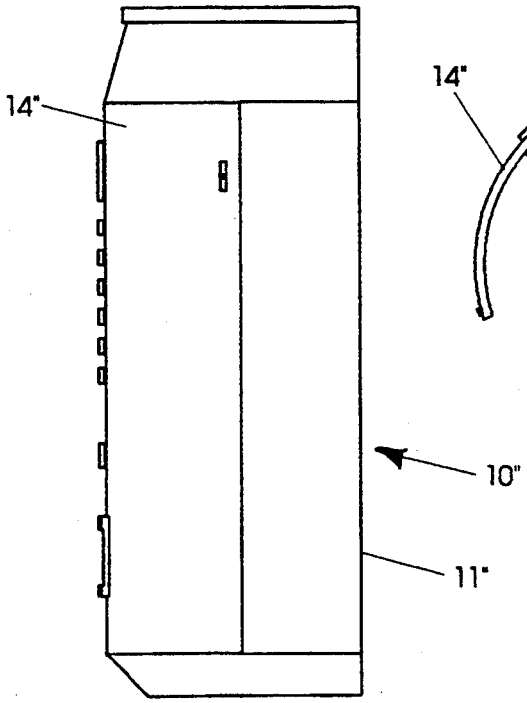
FIGS. 15 and 16 are side and plan views of a version of a semi-cylindrical vending machine with one front door.
Figure 16:
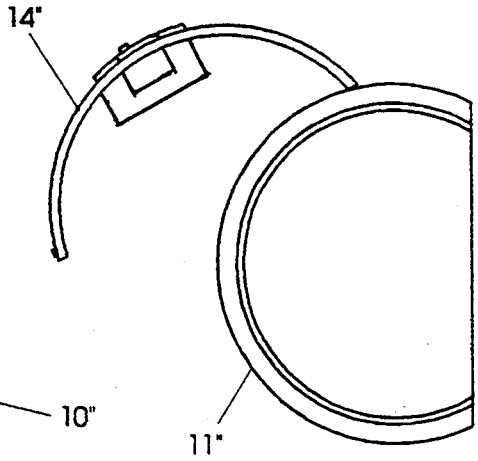

In FIGS. 13 and 14, another version 10' of the beverage vending machine has a full cylindrical body 11' and one arcuate door 14' at the front of the machine. In FIGS. 15 and 16, a further version has a semi-cylindrical body 11" with one front door 14". These versions are used for installations suitable for vending from one side only, e.g., along a wall or in an enclosure. The full cylindrical version preserves the external appearance of the machine as the product being vended. The two arrays of stacks can be used with the interior frame supporting the stacks made rotatable around a central axis (depicted in phantom line at the center of the machine in FIGS. 9 and 10) in order to allow replacement of an empty array with a full array. The semi-cylindrical version can be used for installations with less space or depth for the machine.

In summary, the vending system of the present invention allows vending access from more than the usual one side of the machine, thereby reducing inconvenience and crowding to consumers. The arrangement of stacks and dispensing components within the cylindrical space provides greater machine capacity for the same amount of volume as in a rectangular machine. The use of removably mounted ornamentation provides improved product identification and flexibility in customization. The different versions of the machine also allows greater options for installing the machines in open areas, as well as along walls and in confined areas.

Although the invention has been described with reference to certain preferred embodiments, it will be appreciated that many variations and modifications may be made consistent with the broad principles of the invention. It is intended that the preferred embodiments and all of such variations and modifications be included within the scope and spirit of the invention, as defined in the following claims.

I claim:

1. A vending system comprising:

a main body portion having an external surface in a cylindrical shape and an interior frame, including two opposing side panels spaced apart along a diameter chord of the cylindrical shape, for housing a plurality of stacks and respective dispensing control mechanisms therein for stacking and dispensing of product units to be vended from said vending system, said cylindrically-shaped main body portion having a body height and diameter defining an interior space for housing said plurality of stacks and dispensing control mechanisms therein;

at least one door hinged to a respective one of the side panels and having an arc-curvature shape defining an arcuate external surface that is flush with the external cylindrical surface of the main body portion and a hollow space on an internal side of the arc-curvature of the door, wherein said door has a door height corresponding to the body height of the main body portion and a door arc-width which is less than said body diameter but sufficiently wide to expose substantially the entire interior space housing said plurality of stacks and dispensing mechanisms; and vending and dispensing means including a payment mechanism, selection buttons, and a dispenser slot mounted on said at least one door for allowing payment, selection, and dispensing of a selected product unit from said vending system, wherein said vending and dispensing means are all arranged along a single, vertical centerline of said at least one door in a deepest part of the curvature of the door so as to be positioned in a space of maximum depth within the arc-width of said arcuate door and thereby allow a greater density of stacks of product units and respective dispensing mechanisms to be housed within the interior space of said main body portion.

2. A vending system according to claim 1, wherein said interior frame is formed with a base, the side panels, and an upper mounting plate, and said system includes at least an upper ornamental endpiece removably mounted to the upper mounting plate of said interior frame to allow it to be readily changed according to the type of product to be vended from said vending system.

3. A vending system according to claim 2, further including a bottom ornamental endpiece removably mounted to said base of said interior frame.

4. A vending system according to claim 2, wherein said ornamental endpiece is formed in a shape resembling a beverage can.

5. A vending system according to claim 2, wherein said ornamental endpiece is formed in a shape resembling a bottle.

6. A vending system according to claim 1, having a full cylindrically shaped main body portion and two arcuate doors on opposing sides of said main body portion for allowing vending access from both sides thereof.

7. A vending system according to claim 1, having a full cylindrically shaped main body portion and one arcuate door on a front side of said main body portion for allowing vending access only from the front side thereof.

8. A vending system according to claim 1, wherein said at least one door is mounted by a piano-type hinge extending in a vertical line along the side panel of said main body portion.

9. A vending system according to claim 1, wherein said payment mechanism and selection buttons are incorporated integrally in a compartment that is mounted through said at least one door.

10. A vending system according to claim 2, wherein a refrigeration unit is housed within said base of said interior frame.

11. A vending system according to claim 2, wherein a refrigeration unit is mounted on said upper mounting plate above said interior frame.

12. A vending system according to claim 6, wherein said stacks of product units to be vended are arranged in two sets, wherein each set is provided for vending from a respective one of the opposing sides of said main body portion.

13. A vending system comprising:

a main body portion having an external surface in a cylindrical shape and an interior frame, including two opposing side panels spaced apart along a diameter chord of the cylindrical shape, for housing a plurality of stacks and respective dispensing control mechanisms therein for stacking and dispensing of product units to be vended from said vending system, said cylindrically-shaped main body portion having a body height and diameter defining an interior space for housing said plurality of stacks and dispensing control mechanisms therein;

at least one door hinged to a respective one of the side panels and having an arc-curvature shape defining an arcuate external surface that is flush with the external cylindrical surface of the main body portion and a hollow space on an internal side of the arc-curvature of the door, wherein said door has a door height corresponding to the body height of the main body portion and a door arc-width which is less than said body diameter but sufficiently wide to expose substantially the entire interior space housing said plurality of stacks and dispensing mechanisms; and vending and dispensing means mounted on said at least one door for allowing payment, selection, and dispensing of a selected product from said vending system, wherein said stacks of product units to be vended are arranged in two planar arrays aligned in parallel with each other and with a main body axis defined by the diameter chord extending between the two side panels, wherein a front one of said arrays facing said door has a lesser number of stacks than a rear one of said arrays positioned on the main body axis between the two side panels, for allowing offset spacing of the stacks of said front array within the cylindrical shape of said main body portion and the curvature of said door to obtain an optimal stacking density.

14. A vending system according to claim 13, wherein said stacks of product units to be vended are arranged in two sets of arrays which are rotatably mounted in said main body portion for allowing an empty set to be replaced by a full set for vending via said at least one door.

15. A vending system comprising:

a main body portion having an external surface in a semi-cylindrical shape and an interior frame, including two opposing side panels spaced apart along a diameter chord of the cylindrical shape, for housing a plurality of stacks and respective dispensing control mechanisms therein for stacking and dispensing of product units to be vended from said vending system, said semi-cylindrical-shaped main body portion having a body height and diameter defining an interior space for housing said plurality of stacks and dispensing control mechanisms therein;

a door hinged to one of the side panels and having an arc-curvature shape defining an arcuate external surface that is flush with the external semi-cylindrical surface of the main body portion and a hollow space on an internal side of the arc-curvature of the door, wherein said door has a door height corresponding to the body height of the main body portion and a door arc-width which is less than said body diameter but sufficiently wide to expose substantially the entire interior space housing said plurality of stacks and dispensing mechanisms; and vending and dispensing means mounted on said at least one door for allowing payment, selection, and dispensing of a selected product unit from said vending system, wherein said vending and dispensing means are all arranged vertically along a centerline of said door in a deepest part of the curvature of the door so as to be positioned in a space of maximum depth within the arc-width of said arcuate door and thereby allow a greatest density of stacks of product units and respective dispensing mechanisms to be housed within the interior space of said main body portion.

16. A vending system according to claim 15, further comprising at least an upper ornamental endpiece removably mounted to an upper mounting plate of said interior frame to allow it to be readily changed according to the type of product to be vended from said vending machine.

* * * * *